United States Patent [19]

Prinz et al.

[11] 4,436,790

[45] Mar. 13, 1984

[54] GOLD-COLORED COIN MATERIAL

[75] Inventors: Bruno Prinz, Oberursel; Manfred B. Rockel, Friedrichsdorf; Günther Rudolph, Nueberg; Ulrich Heubner, Werdohl; Hügo Zoebe, Altena, all of Fed. Rep. of Germany

[73] Assignee: Vereinigte Deutsch Metallwerke AG, Frankfurt am Main, Fed. Rep. of Germany

[21] Appl. No.: 370,692

[22] Filed: Apr. 22, 1982

[30] Foreign Application Priority Data

Apr. 23, 1981 [DE] Fed. Rep. of Germany ..... 3116125

[51] Int. Cl.[3] ..... C22C 9/01; C22C 9/02

[52] U.S. Cl. ..... 428/675; 148/433; 420/471

[58] Field of Search ..... 75/154, 162; 428/675; 420/470, 471; 148/433, 436

[56] References Cited

U.S. PATENT DOCUMENTS

| | | | |
|---|---|---|---|
| 1,630,999 | 5/1927 | Bassett, Jr. | 420/471 |
| 1,881,257 | 10/1932 | Bassett, Jr. | 75/154 |
| 2,133,845 | 10/1938 | Crampton et al. | 75/154 |
| 2,231,940 | 2/1941 | Nylander | 75/154 |
| 4,292,377 | 9/1981 | Petersen et l. | 428/675 |
| 4,330,599 | 5/1982 | Winter et al. | 428/675 |

*Primary Examiner*—Peter K. Skiff

*Attorney, Agent, or Firm*—Sprung, Horn, Kramer & Woods

[57] ABSTRACT

A copper-base alloy which consists essentially of 1 to 7% tin and 1 to 7% aluminum and contains aluminum and tin in a total not in excess of 10%, balance copper and inevitable impurities which are due to the manufacturer, is disclosed. It is useful as a coinage material of gold color.

6 Claims, 1 Drawing Figure

GOLD-COLORED COIN MATERIAL

BACKGROUND OF THE INVENTION

1. Field of the Invention

This invention relates to the use of a copper-base alloy containing 1 to 7% tin and 1 to 7% aluminum and containing aluminum and tin in a total not in excess of 10%, balance copper and inevitable impurities due to the manufacture, as a material for use in the making of coins or the like which are required to have a golden color and a high resistance to tarnishing.

2. Discussion of Prior Art

The inflationary tendencies which have prevailed throughout the world for years and differ in strength in various countries, and the considerable increase of transactions effected with the aid of machines for vending merchandise and services, have resulted in a need for coins having a high value. For instance, the introduction of a 10-mark coin has been considered in Germay for some time. In most of the existing systems of coins, it would not be practicable to provide larger coins for a distinction from the most valuable existing coins because the heavier weight and the larger volume would render the handling more difficult and because the larger coins would require a considerable quantity of metal. Additionally, rising prices of the metals which can be used in coins will have the result of decreasing the difference between the metal value and the face value of the coin. For this reason the public authorities who are responsible for the coinage consider the issuing of new coins which have higher values and are smaller than and differ in color from the most valuable existing coins. Gold colors are particularly desirable for such purpose because they are associated with a high value and most coins in circulation, at least those having high values, are silver-colored.

Coin materials having a goldlike color are known and some of them have already been used. They consist almost without exception of copper-base alloys, which contain, e.g., 25% zinc, or 20% zinc and 1% nickel, or 5 to 6% aluminum and 2% nickel, or 2% aluminum and 6% nickel. However, these materials have the disadvantage that they lose their original bright appearance rather quickly in use and assume a dull color having a brownish tinge. Whereas this disadvantage is tolerated with coins having low values, a rapid discoloration of highly valuable coins in use is not acceptable. For this reason, silver-colored materials, particularly nickel or high-nickel alloys, have previously been used for coins of high values.

It is desired to provide a gold-colored material which can be used to make coins or the like and can well be processed to make coins by casting, rolling and stamping and has a high resistance to tarnishing so that it retains as long as possible the original gold color.

SUMMARY OF INVENTION

It has surprisingly been found that this object can be accomplished if the material used to make coins or the like consists essentially of a copper-base alloy which contains 1 to 7% tin and 1 to 7% aluminum and contains aluminum and tin in a total not in excess of 10%, balance copper and inevitable impurities which are due to the manufacture. The total of tin and aluminum is preferably not in excess of 9%. A copper alloy which is particularly desirable contains 5 to 7% Sn and 1 to 3% Al. A copper alloy containing 2.5 to 3.5% Sn and 1.5 to 5.5% Al may also be used within the scope of the invention. The above percentages are percentages by weight.

That copper-base alloy may also be used as a cladding material in the making of coins or the like which have a core layer of another metal, preferably nickel.

Figure 1:
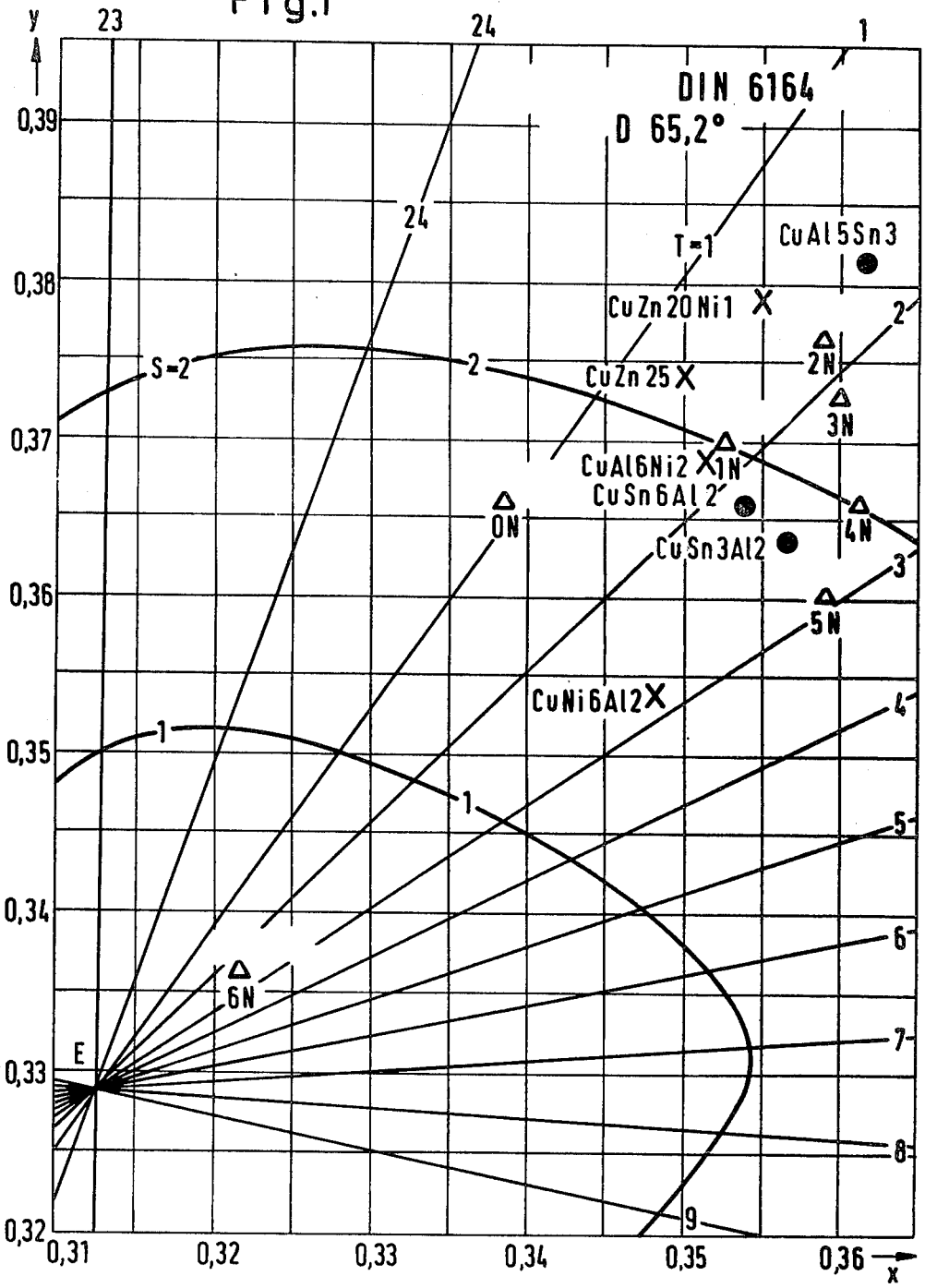
FIG. 1. The accompanying FIGURE is a graph in accordance with Deutsche Industrie Norm (DIN) 6164 of a color system from which color saturation can be determined.

To test the resistance to tarnishing, stamped coin blanks made from the copper-base alloy to be used according to the invention (sample 5:6% Sn, 2% Al; sample 6:5% Al, 3% Sn; sample 7:2% Al, 3% Sn) in a stamped or unstamped form, were first subjected to the following pretreatment:

Bright pickling
Rinsing in water
Treating with a polishing agent
Drying in rice grits without previous rinsing
Optional stamping without additional lubricant.

That pretreatment was required for a test of the stamped or unstamped coin blanks for resistance to tarnishing in that state in which they are used in practice. The coin blanks were also degreased in order to remove any fingerprints before the tarnishing test.

The tests were carried out under the following atmospheric conditions differing in agressiveness:

(A) Exposure to room temperature in the corrosion-testing laboratory. The coins were touched with the fingers and turned round every day.
(B) Exposure to room temperature in the corrosion-testing laboratory.
(C) Exposure to room temperature over a 10% solution of NaCl.
(D) Exposure to room temperature and 80% relative humidity.
(E) Exposure to 45° to 50° C. in the corrosion-testing laboratory.
(F) Exposure to room temperature and 100% relative humidity.

After a testing time of 20 days, the specimens were taken and the coins tested under given conditions were visually inspected and rated from 1 to 5 in accordance with a predetermined system. Rating 1 indicates a very high resistance to tarnishing and rating 5 indicates a very low resistance to tarnishing and a highly tarnished surface.

Blank coins from the above-mentioned known copper-base alloys (samples 1 to 4) were similarly pretreated and tested. The results are compiled in Table 1.

TABLE 1

| Sample No. | A | B | C | D | E | E | Total |
|---|---|---|---|---|---|---|---|
| Comparison Example 1, CuZn25 | 3 | 4 | 3 | 3 | 4 | 5 | 22 |
| Comparison Example 2, CuZn2ONil | 4 | 4 | 4 | 3 | 4 | 5 | 24 |
| Comparison Example 3, CuAl6Ni2 | 2 | 4 | 3 | 3 | 4 | 2 | 19 |
| Comparison Example 4, CuNi6Al2 | 3 | 4 | 3 | 2 | 5 | 5 | 22 |
| Example 5, CuSn6Al2 | 2 | 3 | 3 | 1 | 3 | 3 | 15 |
| Example 6, CuAl5Sn3 | 2 | 3 | 3 | 2 | 3 | 3 | 16 |
| Example 7, CuSn3Al2 | 2 | 4 | 3 | 1 | 4 | 3 | 17 |

The ratings of samples 1 to 4 totalled between 19 and 24. The corresponding total rating of 15 for sample 5 made of the copper-base alloy to be used according to the invention is much lower. This shows that said alloy is clearly superior to all copper-base alloys previously used as a coin material as far as resistance to tarnishing is concerned. Similar remarks are applicable to samples 6 and 7. These have a somewhat lower resistance to tarnishing but are more interesting economically because their tin content is reduced to one half. Additionally, they can be made in other surface colors.

The golden colors were ascertained by a determination of the chromaticity coordinates in accordance with DIN 5033 and the coordinates of the color chart in accordance with DIN 6164 by a measurement of the spectral reflection. The hue T, the saturation S and the darkness value D in the form of the chromaticity coordinates T:S:D of the color chart in accordance with DIN 6164 are compiled in Table 2 for the copper alloys which have been tested:

TABLE 2

| Sample No. | Chromaticity Coordinates (T:S:D) in accordance with DIN 6164 |
|---|---|
| Comparison Example 1, CuZn25 | 1.4:2.1:0.3 |
| Comparison Example 2, CuZn2ONil | 1.4:2.3:0.3 |
| Comparison Example 3, CuAl6Ni2 | 1.8:2.0:0.6 |
| Comparison Example 4, CuNi6Al2 | 2.8:1.4:0.7 |
| Example 5, CuSn6Al2 | 2.2:1.9:0.4 |
| Example 6, CuAl5Sn3 | 1.7:2.5:0.6 |

TABLE 2-continued

| Sample No. | Chromaticity Coordinates (T:S:D) in accordance with DIN 6164 |
|---|---|
| Example 7, CuSn3Al2 | 2.6:1.9:0.4 |

FIG. 1 shows a portion of the color triangle in accordance with DIN 6164. The gold colors according to DIN (Δ), the goldlike colors of the above-mentioned copper-base coin alloys (samples 1 to 4=x) and the gold color of the alloys according to the invention (samples 5 to 7=●) have been entered.

It is apparent that samples 5 and 7 have almost the same saturation as the known coin alloy CuA16Ni2 and are closer in hue to rose gold so that they show a warmer gold color. This is preferred for coins. Whereas sample 6 lies more in a light yellow region, it has a high resistance to tarnishing so that it is much more suitable as a coin material than the control materials.

What is claimed is:

1. A coin made of a copper base alloy consisting essentially of 1 to 7 percent tin and 1 to 7 percent aluminum and containing aluminum and tin in a total not in excess of 10 percent, balanced copper and inevitable impurities due to the manufacture.

2. A coin according to claim 1 wherein the contents of tin and aluminum have a total not in excess of 9 percent.

3. A coin according to claim 1 which contains 5 to 7 percent tin and 1 to 3 percent aluminum.

4. A coin according to claim 1 which contains 2.5 to 3.5 percent tin and 1.5 to 5.5 percent aluminum.

5. A coin according to claim 1 comprising a core and a cladding, said cladding consisting essentially of said copper base alloy.

6. A coin according to claim 5 wherein said core comprises nickel.

* * * * *